United States Patent [19]

Rozmus

[11] 4,312,748

[45] Jan. 26, 1982

[54] METHOD AND APPARATUS FOR CLASSIFYING PARTICLES OF POWDER METAL

[75] Inventor: Walter J. Rozmus, Traverse City, Mich.

[73] Assignee: Kelsey-Hayes Company, Romulus, Mich.

[21] Appl. No.: 149,919

[22] Filed: May 15, 1980

[51] Int. Cl.[3] ..... B07B 4/02

[52] U.S. Cl. ..... 209/5; 209/32; 209/134; 209/142; 209/154; 417/48

[58] Field of Search ..... 209/3, 5, 30–35, 209/132–139 R, 142, 154, 12, 127 R, 127 C, 156, 128–130, 143, 145; 417/48, 49

[56] References Cited

U.S. PATENT DOCUMENTS

| | | | |
|---|---|---|---|
| 2,155,489 | 4/1939 | Herrin | 209/135 |
| 2,583,456 | 1/1952 | Winquist | 209/154 X |
| 3,400,882 | 9/1968 | McManus | 417/48 |
| 3,572,503 | 3/1971 | Hezel | 209/135 X |
| 3,933,626 | 1/1976 | Stukel et al. | 209/134 |
| 3,972,808 | 8/1976 | Manley | 209/133 |

FOREIGN PATENT DOCUMENTS

| | | | |
|---|---|---|---|
| 2657754 | 6/1978 | Fed. Rep. of Germany | 209/135 |
| 545573 | 10/1922 | France | 209/135 |

*Primary Examiner*—Ralph J. Hill
*Attorney, Agent, or Firm*—McGlynn and Milton

[57] ABSTRACT

A method and apparatus for classifying desirable particles of powder metal by size and removing particles of undesirable material of a different density than the metal particles. There is included a housing defining a closed flow path for a recirculated stream of protective gas different than ambient air. A particle supply device introduces particles into the housing at a controlled rate in a downwardly falling stream. A plurality of receptacle trays are disposed in the housing generally vertically below the particle supply device with each tray having a forward lip positioned forwardly in the direction of the gas flow of the trays thereabove. An electrostatic gas ionizer is disposed upstream of the particle supply device for ionizing the gas and a screen is disposed in the stream of gas between the ionizer and the particle supply device for attracting the ionized gas from the ionizer while allowing the passage of the gas through the screen for establishing the recirculated stream of gas to impinge the stream of falling particles to impart to each particle a horizontal component of velocity so that the trajectories of the particles will vary depending upon size and density thereof for falling into the various receptacle trays. Consequently, the desirable particles are classified by size, undesirable particles of a different density than the desirable particles are removed or separated out, undesirable hollow particles are also removed or separated out, and because of the charge placed thereon, clusters of particles are broken up, i.e., the particles in such a cluster repel one another and separate.

25 Claims, 7 Drawing Figures

METHOD AND APPARATUS FOR CLASSIFYING PARTICLES OF POWDER METAL

BACKGROUND OF THE INVENTION (1) Field of the Invention

This invention relates to an apparatus for classifying particulate material under a controlled atmosphere. The apparatus of the subject invention is particularly suited for classifying powdered metal by size and removing particles of undesirable material of lower density than the metal particles.

In the processing of certain powder metals, such as nickel, titanium and cobalt-base superalloys, it is necessary to separate the powdered metal particles into size ranges. For example, the particles may be cold-worked by the introduction of strain energy into the individual particles of the powder metal by deforming the particles between a pair of rolls in a rolling mill. So that all of the particles which pass between the rolls of such a roll mill are deformed, they must be of a relatively similar size or in a size range.

(2) Description of the Prior Art

There are assemblies known in the prior art for classifying particulate material by use of a stream of gas impinging upon the particles whereby the smaller or less dense particles will have greater trajectories than the larger or more dense particles. However, such assemblies do not provide the desired preciseness in classification of the various particle size ranges because the gas stream and the gas stream path result in turbulence and eddy currents which interfere with the desired classification. Further, the prior art assemblies are to a degree deficient in the separation of the various particles because the particles may group or cluster together which, of course, reduces the preciseness in the classification.

SUMMARY OF THE INVENTION

The subject invention relates to a method and apparatus for classifying desirable particles of powder by size and removing particles of undesirable material of a different density than the desirable particles with a housing defining a closed flow path for a recirculated stream of gas and particle supply means for introducing particles into the housing at a controlled rate in an initially downwardly falling stream of particles of desirable material and undesirable material. A series of particle-receiving receptacles are located below and downstream of the particle supply means and serially arranged along the direction of flow of the stream of gas in a direction away from the particle supply means for collecting particles of a different predetermined size range for each receptacle and particles of undesirable material of a different size than the predetermined size range for each respective receptacle. An electrostatic gas ionizer is disposed upstream of the particle supply means for ionizing the gas and a screen is disposed in the stream of gas between the ionizer and the particle supply means for attracting the ionized gas from the ionizer while allowing the passage of gas therethrough for establishing the recirculated stream of gas to impinge the stream of falling particles to impart to each particle a horizontal component of velocity so that the trajectories of the particles will vary depending upon the size and density thereof.

PRIOR ART STATEMENT

As alluded to above, there are known systems for classifying particles by volume and density. A basic such system utilizing a flow of air to impinge particles is disclosed in French Pat. No. 336,106 dated Oct. 17, 1903. That patent discloses an open system having a fan for creating the gas flow. There are also known closed recirculating gas systems utilizing fans or blowers and an example of same is disclosed in U.S. Pat. No. 3,933,626 granted to Stukel et al on Jan. 20, 1976. These prior art assemblies utilize gas at a relatively high velocity with the consequent turbulence, such as eddy currents, which greatly interfere with the classification of the particles by size and density. As alluded to above, the better the separation between individual particles, the better the classification and prior art assemblies allow for particles to group or cluster together to reduce the effectiveness of the classification. In accordance with the subject invention there is provided a classifier utilizing a very low velocity of gas thereby minimizing turbulence and which also more effectively causes the individual particles to separate from one another to classify the particles into well-defined and more precise ranges of size and density.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
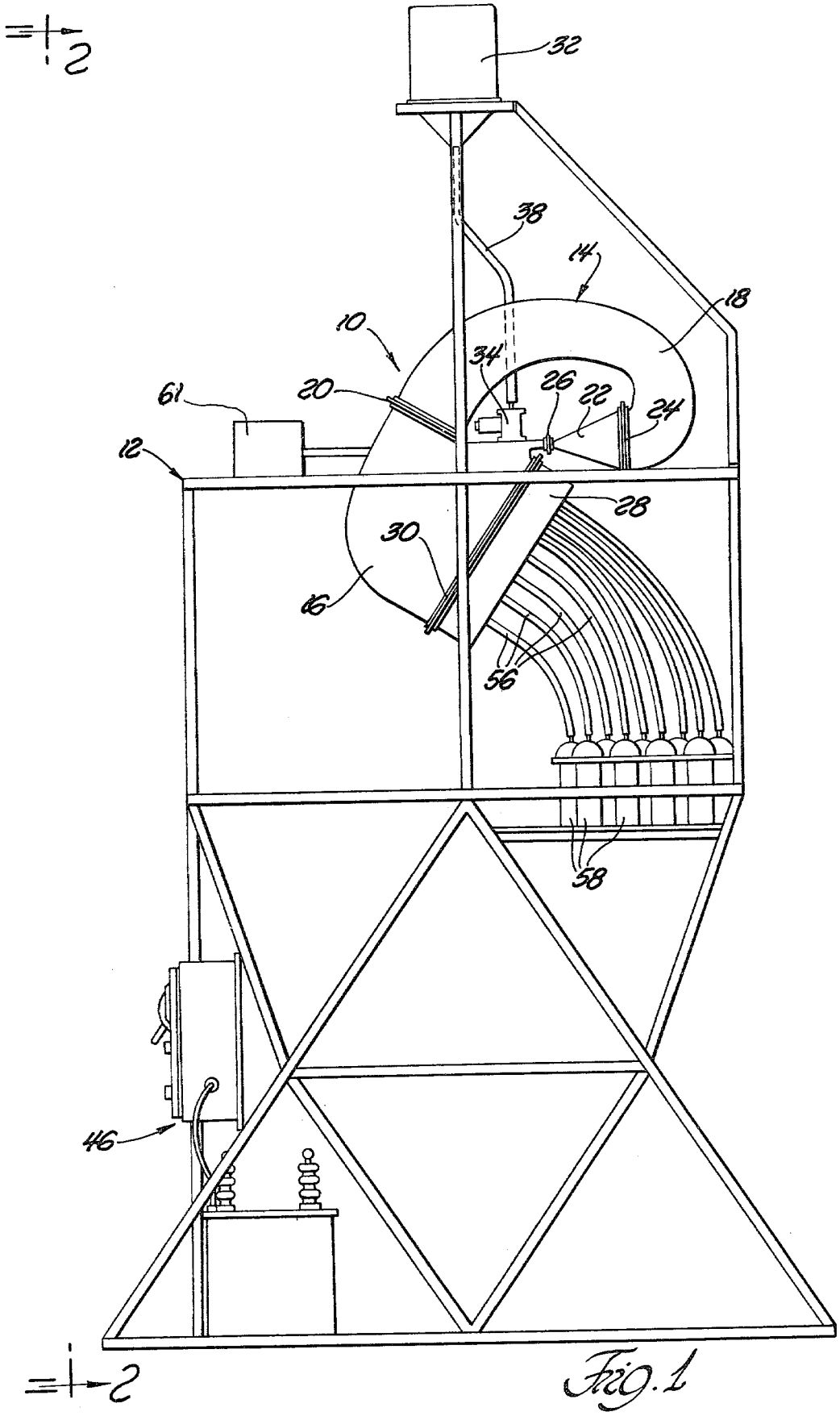
FIG. 1 is a side-elevational view of an apparatus incorporating the subject invention.
Figure 2:
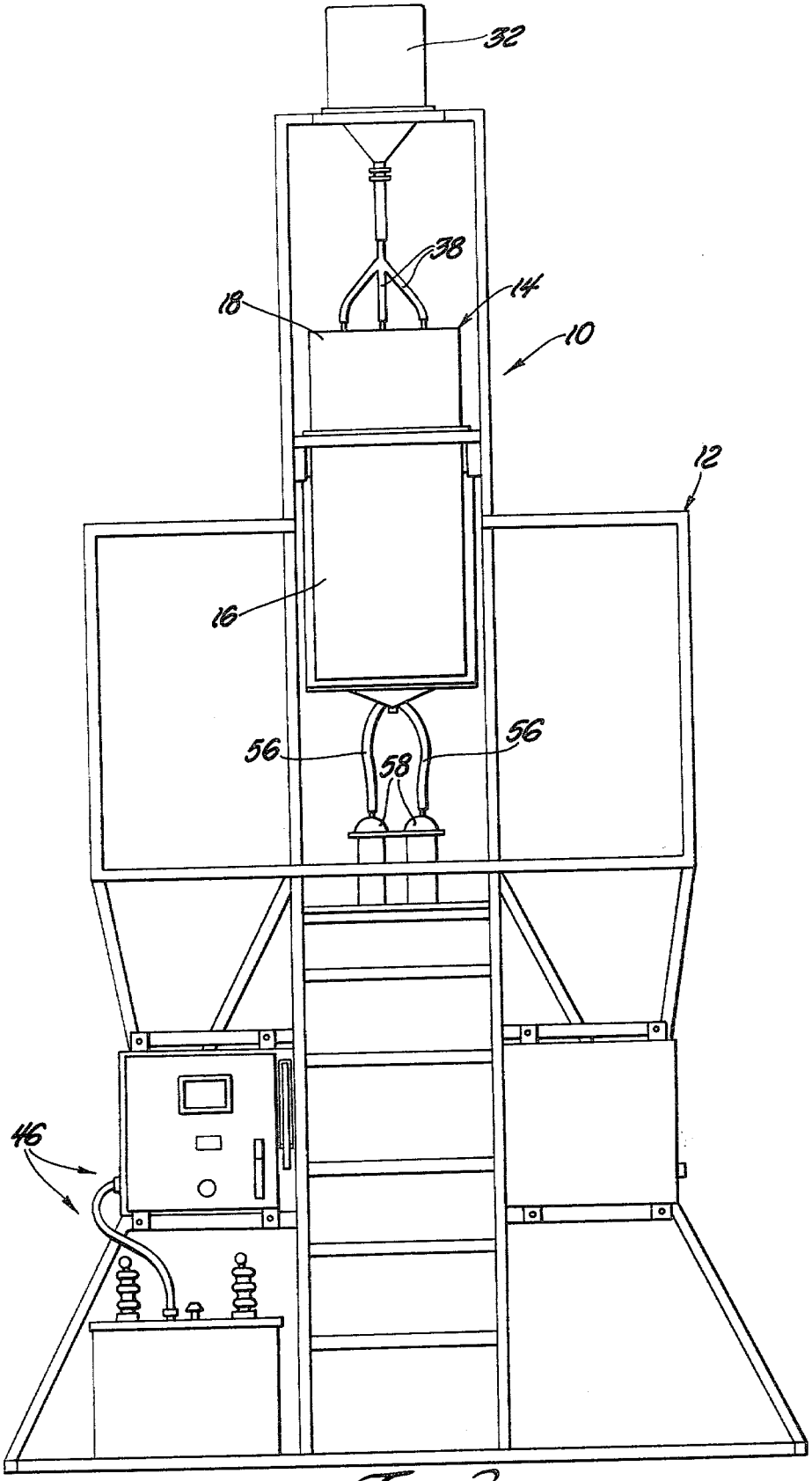
FIG. 2 is a frontal view taken substantially along line 2—2 of FIG. 1.
Figure 3:
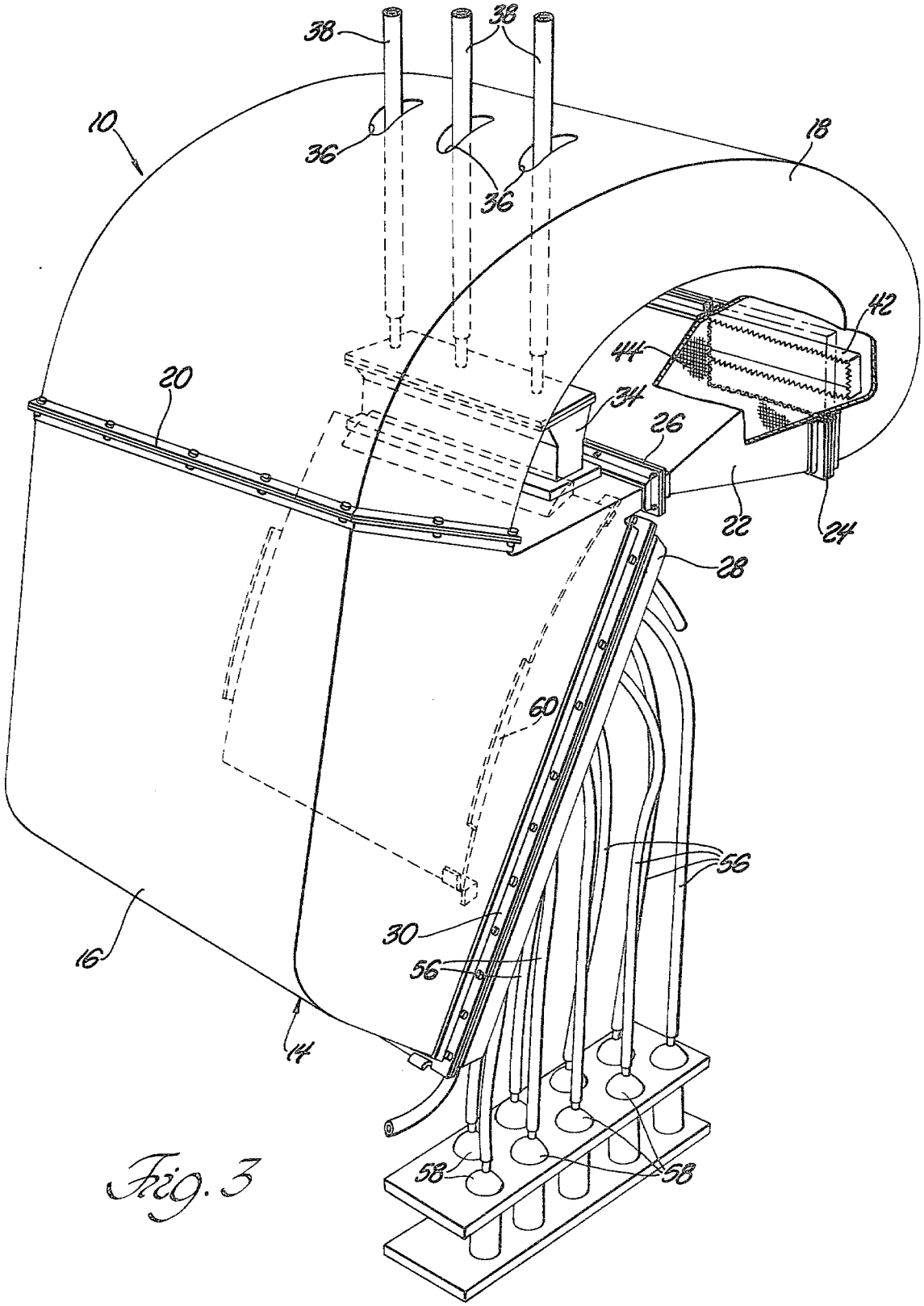
FIG. 3 is a perspective view partially broken away and in cross section of an apparatus constructed in accordance with the subject invention.

An apparatus for classifying desirable particles of powder by size and removing particles of undesirable material of a different density than the desirable particles is generally shown at 10. Although the invention has other applications and modes of operation as will be discussed hereinafter, it is particularly suited for and will be described in connection with the classification of powder metal by size and removing particles of undesirable particles of a lower density than the powder metal particles.

The apparatus 10 is supported on a framework generally indicated at 12.

The apparatus 10 includes a housing generally indicated at 14. The housing 14 defines a closed flow path for a recirculated stream of protective gas, the protective gas being different than ambient air, such as dried air or an inert gas like argon. The housing is preferably made of sheet metal components which are bolted together to provide a sealed enclosure for recirculating the stream of gas. The housing includes a lower return portion 16 and an upper return portion 18 with the two portions 16 and 18 bolted together at the flanged interface 20. The housing also includes a nozzle portion 22 having an inlet bolted to the upper return portion 18 at the flanged interface 24 and an outlet bolted to the lower housing portion 16 at the flanged interface 26. The housing 14 also includes a receptacle tray support pan 28 bolted to the lower housing portion 16 at the flanged interface 30.

The apparatus 10 also includes particle supply means for introducing particles into the housing 14 at a controlled rate in an initially downwardly falling stream of desirable particles of powder metal and particles of undesirable material. Specifically, the framework 12 supports a container 32 which includes particles of powdered metal of various different sizes as well as particles of undesirable lower density materials such as ceramic. The powder particle supply means also includes the dispensing device 34 which continually provides a falling curtain of particulate material into the upper portion of the lower housing section 16 to be impinged by a horizontal flow of gases. The dispensing device 34 dispenses a sheet of particulate material through the opening 35 in the lower housing portion 16. The upper return housing portion 18 has three tubular passages 36 extending therethrough, which are in the shape of an airfoil to allow smooth gas flow thereabout, and supply tubes 38 extend through the passages to convey particulate material from the container 32 to the dispensing device 34. Various dispensing devices may be utilized for dropping a thin curtain of particulate material and one such suitable device is disclosed and claimed in applicant's copending application Ser. No. 139,907, filed Apr. 14, 1980.

A series of particle-receiving receptacles defined by the trays 40 are located below and downstream of the dispensing device 34 of the particle supply means. The trays 40 are serially arranged along the direction of flow of the stream of gas in a direction away from the dispensing device 34 for collecting particles of powder metal of a different predetermined size range for each receptacle 40 and particles of undesirable material of larger size than the predetermined size range for each respective receptacle.

An electrostatic gas ionizer 42 is disposed upstream of the dispensing device 34 for ionizing the gas circulating within the housing 14. A screen 44 is disposed in the stream of gas between the ionizer 42 and the dispensing device 34 for attracting the ionized gas from the ionizer 42 while allowing the passage of that gas through the screen 44 for establishing the recirculated stream of gas. The stream of gas established by the electrostatic gas ionizer 42 and the screen 44 impinges the stream of falling particles from the dispensing device 34 to impart to each particle a horizontal component of velocity so that the trajectories of the particles will vary depending upon the size and density thereof.

The electrostatic gas ionizer 42 comprises a plate defining a four-sided box without top or bottom with the forward edge thereof facing the screen 44 and being serrated to define sharp teeth. The sharpness of the teeth facilitates electron flow from or to the ionizer 42, depending upon the positive or negative nature of the charge. The ionizer 42 is supported within the housing 14 in an insulated manner and has a lead extending therefrom to the charge means generally shown at 46. The charge means 46 establishes an electron polarity, either positive or negative, on the electrostatic gas ionizer 42 and an opposite polarity on the screen 44. In the disclosed embodiment, the charge means 46 establishes an electron charge on the ionizer 42 which may be either positive or negative and the screen 44 is grounded. The screen 44 is a mesh screen supported at the flanged interface 24.

The nozzle portion 22 is immediately upstream of the dispensing device 34 of the particle supply means. Specifically, the outlet of the nozzle 22 at the flanged interface 26 is immediately upstream of the dispensing device 34. The inlet to the nozzle 22 at the flanged interface 44 is downstream and spaced from the ionizer 42 and the nozzle 22 has a decreasing cross-sectional area from the inlet at 44 to the outlet at 26. Said another way, the top and bottom walls of the nozzle 22 converge from the inlet thereof to the outlet thereof.

There is also included flow straighter means comprising a pair of corrugated sheets or plates 48 at the outlet of the nozzle 22 for directing the stream of gas horizontally toward the falling stream of particles which fall through the opening 35. The corrugated sheets or plates 48 are separated by a sheet 50 whereby the sheets 48 define a plurality of individual straight flow paths. Further, the sheets 48 and 50 have the same polarity as the screen 44 to further neutralize ionized gas which was not neutralized by the screen. In other words, as the ionizer 42 ionizes the gas, the gas is attracted toward the screen 44 thereby gaining the momentum to flow through into and through the nozzle 22. Although some quantities of gas will be partially deionized by the screen, the flow straightening sheets 48 and 50 will be grounded like the screen 44 to further deionize or neutralize the ionized gas, but the gas will remain in part ionized after passing the sheets 48 and 50.

The receptacle trays 40 are disposed in the housing 14 generally vertically below the dispensing device 35 of the particle supply means. Each receptacle tray 40 has a forward lip 52 with the forward lip 52 of each successive receptacle tray, from the top receptacle tray 40 to the bottom receptacle tray 40, having its forward lip 52 positioned forwardly of the remaining receptacles thereabove in the direction of the gas flow through the nozzle outlet of nozzle 22. In other words, the lip 52 of each receptacle tray is disposed forwardly in the direction of the gas flow of the receptacle trays 40 thereabove.

Figure 4:
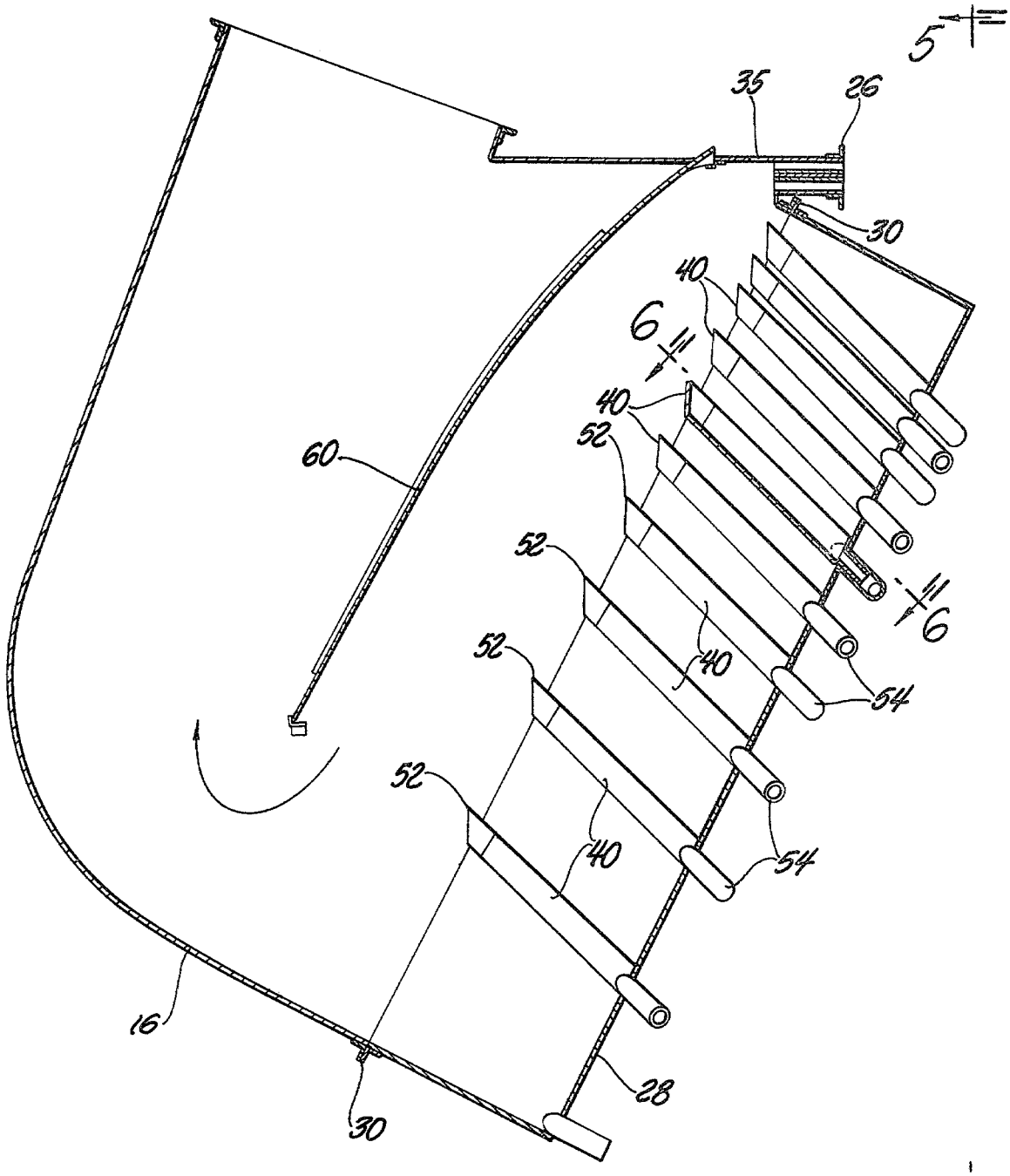
FIGS. 4 and 4*a*, when combined, are a cross-sectional view through the assembly illustrated in FIG. 3.
Figure 4A:
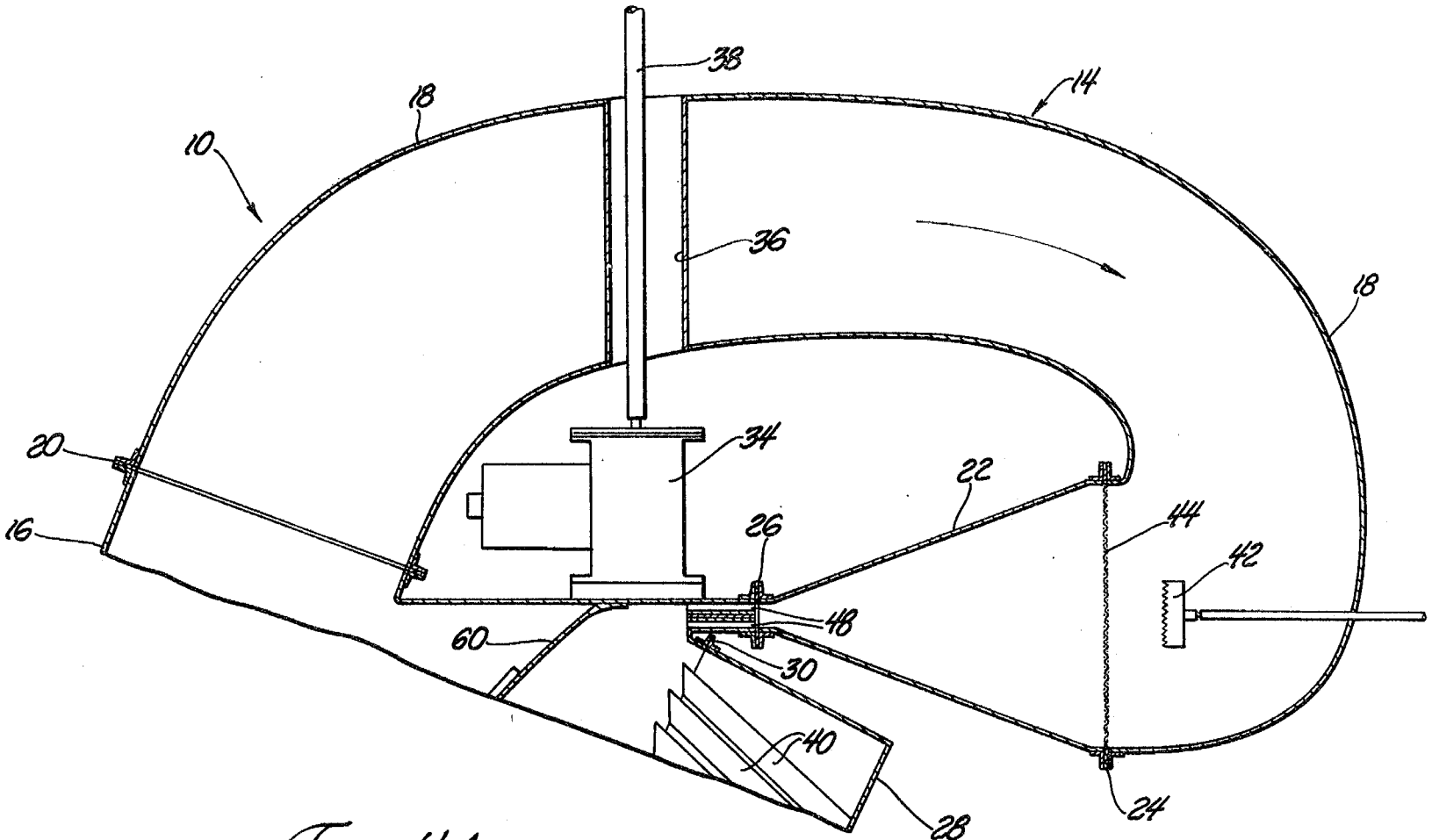
Figure 5:
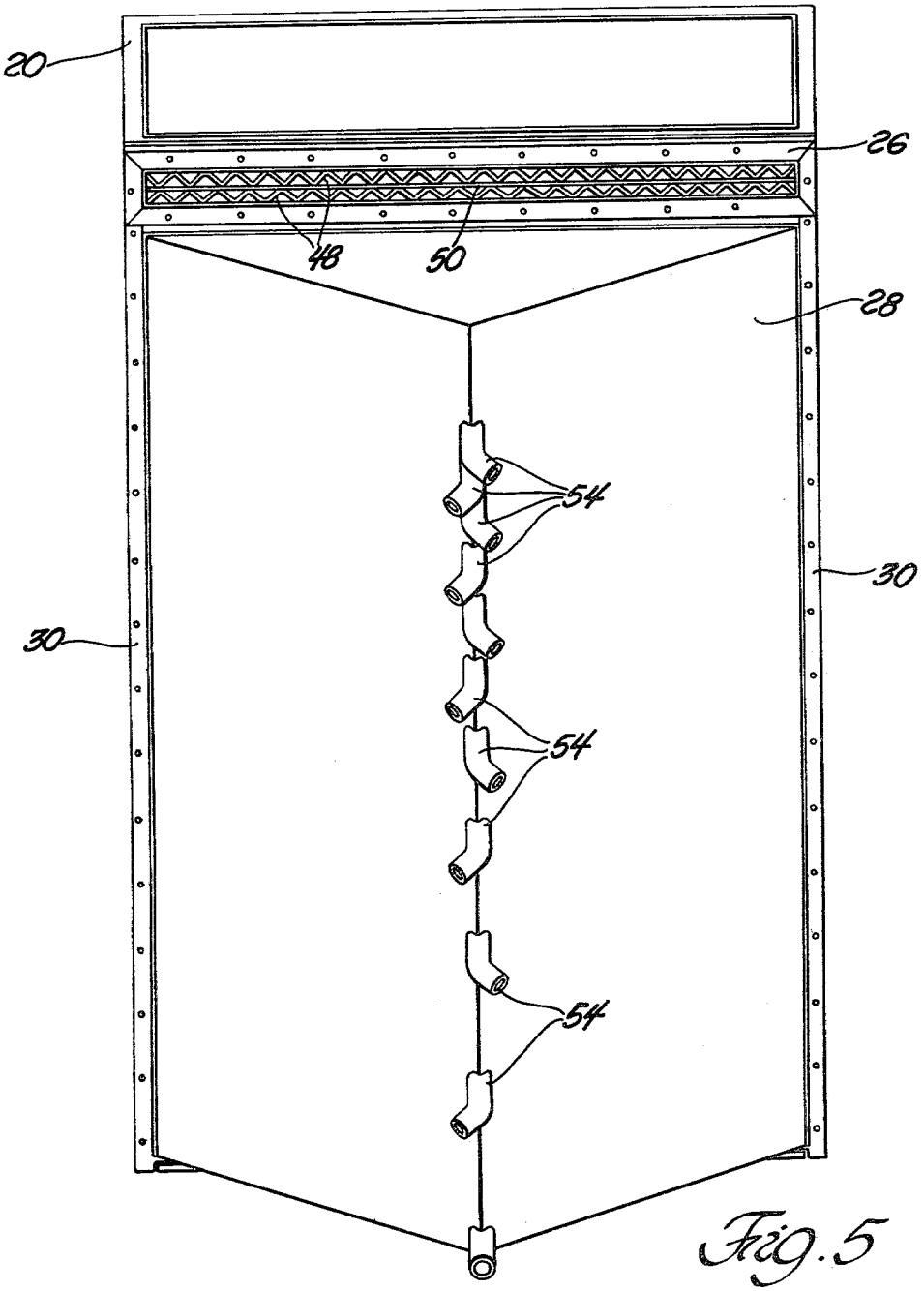
FIG. 5 is a view taken substantially along line 5—5 of FIG. 4.
Figure 6:
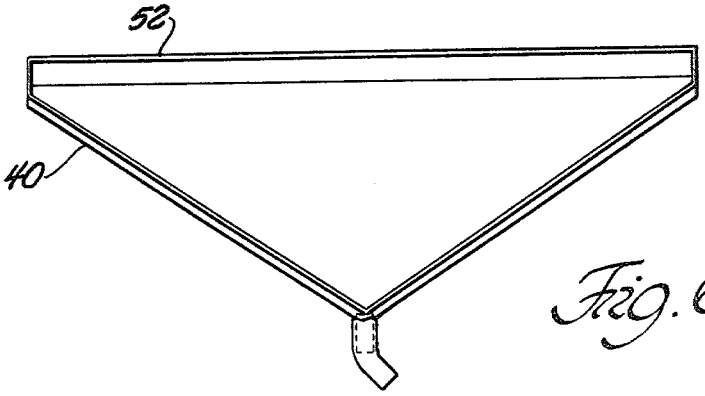
FIG. 6 is a cross-sectional view taken substantially along line 6—6 of FIG. 4.

Each of the trays 40 has a bottom which slants downwardly and rearwardly from the lip 52 thereof as best illustrated in FIG. 4. As best illustrated in FIG. 6, the bottom of each of the trays 40 is triangularly shaped so that the sides of each bottom converge rearwardly and downwardly from the lip 52 thereof to an apex. In a similar fashion the tray support pan 28 has a V-shaped bottom for receiving the respective trays 40 and the trays 40 are welded to the support pan 28.

There is included a plurality of particle outlet tubes 54 with each of the outlet tubes 54 disposed at the apex of one of the trays 40 for receiving the particles collected in the trays 40. The outlet tubes 54 are connected by hoses 56 to a plurality of containers 58. The lower most outlet at the bottom of the support pan 28 is for removing dust, i.e., superfine particles which fall to the bottom of the support pan 28.

The front walls of each of the trays 40 defining the lips 52 are all vertical and the upper edge of the front wall defining the lip 52 is always forward of the lower extremities of the front wall whereby particles may pass by the lip of each tray to be received by the next lower tray. Further, the lips 52 of all of the trays 40 are aligned along a straight line albeit that straight line is slanted downwardly and forwardly from the vertical. The housing 14 includes a baffle 60 spaced forwardly of the trays 40 and curved slightly at its upper end to extend downwardly from a position downstream of the dispensing device 34 in a generally parallel relationship to the straight line defined by the lips 52 of the trays 40.

Further, the trays 40 are successively spaced an increasingly greater vertical distance apart from the top tray 40 to the bottom tray 40. Thus, the housing defines a return gas flow path from the bottom of the baffle 60 and up and over the nozzle outlet at the flange interface 26 to the nozzle inlet at the flange interface 24.

Also supported upon the framework 12 is a gas supply means 61 for supplying a protective gas different from ambient air within the housing. The gas supply means also maintains a positive gas pressure within the housing, i.e., above ambient or atmospheric pressure. Preferably dried air or an inert gas, such as argon, is supplied within the housing and continuously recirculated.

As will be appreciated, gas is continuously recirculated through the housing as a charge is applied to the electrostatic gas ionizer 42 to ionize the gas as it approaches the inlet to the nozzle 22. The screen 44 disposed across the inlet to the nozzle 22 is grounded to attract the ionized gas. However, the ionized gas passes through the screen 44 and is partially neutralized but has gained momentum and, therefore, continues to flow through the nozzle 22. This gas momentum draws gas upstream to the ionizer and, because the flow path is closed, a continuous recirculation of gas is established. The flow straightener defined by the sheets 48 and 50 straightens the flow of gas so that it impinges a falling sheet of particulate material but with very low velocity and, therefore, very low turbulence. Accordingly, the trays 40 are aligned substantially vertically but placed one ahead of the other successively in the downward direction as the low velocity imparts small trajectories even to the lightest materials because of the low velocity.

The subject invention provides a classification which is very specific, precise and well-defined and substantially more so in comparison to prior art assemblies. Four major functions are performed by the subject invention. The desirable particles are classified by size. Undesirable particles of a different density than the desirable particles are removed or separated out. Undesirable hollow particles are also removed or separated out. Additionally, because of the charge placed upon the particles, clusters or groups of particles are broken up because the particles in such clusters or groups repel one another and separate. As stated above, the more the various particles are separated from one another, the more precise will be the classification and separation or removal. As the particles are charged by the ionized gas, they are all charged with the same polarity and, therefore, repel one another. This is particularly significant with the grouping or cluster of particles which are frequently held together electrostatically. When these particles are charged with the same polarity, they repel one another thereby breaking up the clusters. It will be appreciated that a group or cluster of particles held together could react like a larger particle if the particles within the cluster or group are not broken up and separated from one another. Because of the higher degree of separation of the various particles, the trajectories of the particles are more precise thereby affording more precise separation and classification. Further, the baffle 60 is metal and becomes charged because of its contact with the flow of ionized gas. Accordingly, the baffle 60 attracts the falling particles. Since the nonmetallic undesirable particles retain their charge longer than the metal particles, their trajectories will be increased by the attraction to the baffle 60 and, therefore, the less dense nonmetallic particles will have their trajectories increased so as to fall to or closer to the bottom of the housing. Additionally, the bottom of the housing will also attract the superfine dust particles to prevent their recirculation and the collected dust particles may be removed from the bottom of the housing, as out the lower most tube.

The invention has been described in connection with classifying metal particles by size while removing ceramic particles of a lesser density. This is accomplished as the particles in a given size range fall into one of the trays 40 and are removed therefrom through the associated tube 54. Because the less dense ceramic particles have less mass or weight for size than the metal particles, each of the ranges of metal particles in each tray 40 will also include larger undesirable particles. Accordingly, as those particles move out a tube 54 associated with a tray, screens will be utilized to screen out the larger undesirable particles from the smaller range of desirable metal particles. As will be appreciated, the screens associated with the various tubes 54 will have the smallest mesh with the topmost tray 40 with the mesh of the screens increasing with the respective screens associated with the tubes 54 successively downwardly. As will be readily appreciated, the invention has another mode whereby more dense undesirable particles may be separated from less dense particles by merely screening out for each successive tube 54 the desirable particles while allowing the undesirable more dense smaller particles to pass through the respective screens.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. An apparatus (10) for classifying desirable particles of powder material by size and removing particles of undesirable material of a differnt density than the desirable particles, said apparatus (10) comprising; a housing (14) defining a closed flow path for a recirculated stream of gas, particle supply means (34) for introducing particles into the housing at a controlled rate in an initially downwardly falling stream of particles of desirable material and undesirable material, a series of particle-receiving receptacles (40) located below and downstream of said particle supply means and serially arranged along the direction of flow of the stream of gas in a direction away from said particle supply means (34) for collecting desirable particles of a different predetermined size range for each receptacle (40) and particles of undesirable material of a different size than said predetermined size range for each respective receptacle (40), an electrostatic gas ionizer (42) disposed upstream of said particle supply means (34) for ionizing the gas and a screen (44) in the stream of gas between said ionizer (42) and said particle supply means (34) for attracting the ionized gas from said ionizer (42) while allowing the passage of gas therethrough for establishing the recirculated stream of gas to impinge the stream of falling particles to charge the particles and impart to each particle a horizontal component of velocity so that the particles repel one another and the trajectories of the particles will vary depending upon the size and density thereof.

2. An apparatus as set forth in claim 1 including charge means (46) for establishing an electron polarity on said electrostatic gas ionizer (42) and an opposite polarity on said screen (44).

3. An apparatus as set forth in claim 2 including a nozzle (22) upstream of said particle supply means (34).

4. An apparatus as set forth in claim 3 wherein said nozzle (22) includes an outlet (26) immediately upstream of said particle supply means (34) and an inlet (24) downstream of said ionizer (42), said nozzle (22) having a decreasing cross-sectional area from said inlet (24) to said outlet (26).

5. An apparatus as set forth in claim 4 wherein said screen (44) is disposed at said inlet (24) of said nozzle (22).

6. An apparatus as set forth in claim 5 including flow straightener means (48, 50) at said outlet (26) of said nozzle (22) for directing the stream of gas horizontally toward the falling stream of particles.

7. An apparatus as set forth in claim 6 wherein said flow straightener means (48, 50) comprises at least one corrugated sheet (48) extending across said outlet (26) to define a plurality of individual straight flow paths.

8. An apparatus as set forth in claim 6 wherein said flow straightener means (48, 50) has the same polarity as said screen to further neutralize ionized gas not neutralized by said screen (44).

9. An apparatus as set forth in claim 6 including gas supply means for supplying a protective gas different from ambient air within said housing (14).

10. An apparatus as set forth in claim 9 wherein said gas supply means maintains a positive gas pressure within said housing (14).

11. An apparatus as set forth in claim 6 wherein said ionizer (42) comprises a plate defining a four-sided box with the forward edge thereof facing said screen and being serrated to define sharp teeth.

12. An apparatus as set forth in claim 6 wherein said receptacles (40) are disposed in said housing (14) generally vertically below said particle supply means (34), each of said receptacles (40) having a forward lip (52) with the forward lip (52) of each successive receptacle (40) from the top receptacle (40) to the bottom receptacle (40) being positioned forwardly of the remaining receptacles (40) thereabove in the direction of the gas flow through the nozzle outlet (26).

13. An apparatus as set forth in claim 12 wherein said receptacles (40) comprise a plurality of trays each of which has a bottom slanting downwardly and rearwardly from the lip (52) thereof.

14. An apparatus as set forth in claim 13 wherein said trays (40) are vertically spaced varying distances apart.

15. An apparatus as set forth in claim 13 wherein the bottom of each of said trays (40) is triangularly shaped so that the sides of each bottom converge rearwardly and downwardly from the lip (52) thereof to an apex.

16. An apparatus as set forth in claim 15 including a plurality of particle outlets (54) with each outlet disposed at said apex of one of said trays (40) for receiving the particles collected by said trays (40).

17. An apparatus as set forth in claim 16 wherein said lips (52) are aligned along a straight line and said housing (14) includes a baffle (60) spaced forwardly of said trays (40) and curved slightly to extend downwardly from a position downstream of said particle supply means (34) in a generally parallel relationship to said straight line.

18. An apparatus as set forth in claim 17 wherein said trays (40) are successively spaced an increasingly greater vertical distance apart from the top tray (40) to the bottom tray (40).

19. An apparatus as set forth in claim 18 wherein said housing (14) defines a return gas flow path from the bottom of said baffle and up and over said nozzle outlet (26) to said nozzle inlet (24).

20. An apparatus as set forth in claim 1 wherein said receptacles (40) are disposed in said housing (14) generally vertically below said particle supply means (34), each of said receptacles (40) having a forward lip (52) with the forward lip (52) of each successive receptacle (40) from the top receptacle (40) to the bottom receptacle (40) being positioned forwardly in the direction of the gas flow of the remaining receptacles (40) thereabove.

21. An apparatus as set forth in claim 20 including a baffle (60) spaced forwardly of said trays (40) and curved slightly to extend downwardly from a position downstream of said particle supply means (34).

22. An apparatus as set forth in claim 21 wherein said receptacles (40) comprise a plurality of trays each of which has a bottom slanting downwardly and rearwardly from the lip (52) thereof.

23. An assembly as set forth in claim 22 wherein the bottom of each of said trays (40) is triangularly shaped so that the sides of each bottom converge rearwardly and downwardly from the lip (52) thereof to an apex.

24. A method of classifying desired particles of particulate material by size and removing undesired particles of particulate material of a different density than the desired particles comprising the steps of; defining a closed flow path for a recirculated stream of gas having a horizontal portion of flow, introducing particles into the horizontal portion of flow at a controlled rate in an initially downwardly falling stream of desired and undesired particles, collecting the desired and undesired particles below and downstream of the falling stream in separate receptacles serially arranged along the direction of the flow of gas for collecting desired particles of a different predetermined size range of each receptacle and undesired particles of a different size range than the predetermined size range for each respective receptacle, establishing the flow of gas upstream of the falling stream by ionizing the gas and attracting the ionized gas for providing the horizontal portion of flow to impinge the falling stream of particles to charge the particles and impart to each particle a horizontal component of velocity so that the particles repel one another and the trajectories of the particles will vary depending upon the size and density thereof.

25. A method as set forth in claim 24 further defined as establishing an electrical polarity for attracting and neutralizing the ionized gas and establishing an opposite electrical polarity upstream in the gas flow.

* * * * *